US007444845B2

(12) United States Patent
Kargilis et al.

(10) Patent No.: US 7,444,845 B2
(45) Date of Patent: Nov. 4, 2008

(54) RETAINER FOR A DOOR LOCK

(75) Inventors: John S. Kargilis, Northville, MI (US); Philippe Pontols, Sterling Heights, MI (US)

(73) Assignee: Chrysler LLC, Auburn Hills, MI (US)

( * ) Notice: Subject to any disclaimer, the term of this patent is extended or adjusted under 35 U.S.C. 154(b) by 29 days.

(21) Appl. No.: 11/549,666

(22) Filed: Oct. 16, 2006

(65) Prior Publication Data

US 2008/0087061 A1 Apr. 17, 2008

(51) Int. Cl.
*E05B 9/08* (2006.01)

(52) U.S. Cl. ..... 70/370; 70/451; 70/466

(58) Field of Classification Search ..... 70/370, 70/371, 451, 452, DIG. 40, 368, 417, 448, 70/449, 466; 403/21, 22
See application file for complete search history.

(56) References Cited

U.S. PATENT DOCUMENTS 1,207,465 A * 12/1916 Augenbraun ..... 70/370
2,040,258 A * 5/1936 Jacobi ..... 70/370
2,443,362 A * 6/1948 Tinnerman ..... 70/370
2,610,500 A * 9/1952 Poupitch ..... 70/370
2,744,185 A * 5/1956 Cawley ..... 200/316
2,948,141 A * 8/1960 Vahlstrom ..... 70/370
3,776,008 A * 12/1973 Schlage ..... 70/368
3,868,836 A * 3/1975 La Roche ..... 70/240
3,964,280 A * 6/1976 Kelton ..... 70/84
4,381,656 A * 5/1983 Hayakawa ..... 70/451
4,492,101 A * 1/1985 Tanaka ..... 70/370
4,765,165 A * 8/1988 O'Gara ..... 70/417
4,873,852 A * 10/1989 Neyret ..... 70/451
5,410,899 A * 5/1995 McConnell ..... 70/370
5,551,268 A 9/1996 Carnes et al.
5,636,540 A * 6/1997 Myers ..... 70/370
5,931,035 A 8/1999 Bolton
6,105,405 A * 8/2000 Westwinkel ..... 70/371
6,901,638 B2 * 6/2005 Itou et al. ..... 24/570

* cited by examiner

*Primary Examiner*—Lloyd A Gall
(74) *Attorney, Agent, or Firm*—Ralph E. Smith

(57) ABSTRACT

A retainer assembly for resisting detachment of a door lock cylinder from an opening in a door panel includes a retainer clip engaged with the door lock cylinder to prevent the door lock cylinder from being separated from the opening in the door panel, and a keeper for holding the retainer clip engaged with the door lock cylinder.

13 Claims, 4 Drawing Sheets

RETAINER FOR A DOOR LOCK

FIELD OF THE INVENTION

The present invention relates generally to locking devices and more particularly to a retainer assembly for resisting unauthorized detachment of a lock cylinder from a door.

BACKGROUND OF THE INVENTION

Locks are provided on doors to restrict entry through an opening controlled by the door and also to prevent unauthorized persons from gaining entry. One problem with most vehicle door locks is that without some sort of retention device, the lock cylinder may be quickly and easily "punched out" or otherwise detached from the door. What is needed is a retainer assembly which will prevent an unauthorized person from removing the lock cylinder, or at least make it difficult and time-consuming for this to be done.

SUMMARY OF THE INVENTION

In accordance with the present invention, a retainer assembly is provided for the lock cylinder which includes a retainer clip for preventing the lock cylinder from being separated from the door, and a keeper for holding the retainer engaged with the lock cylinder.

Further in accordance with the invention, the retainer clip and keeper are applied directly to the lock cylinder. They are free of direct attachment to the door itself, and, therefore, no separate fasteners are required. Because fasteners are not required, no fastener holes need to be drilled. As a result, the cost of the installation and the time needed to make the installation, are reduced to a minimum In the specific embodiment about to be described, the retainer clip has laterally spaced apart legs engaged in grooves in the lock cylinder, and the keeper has a slot into which a flange of the retainer clip extends to prevent the retainer clip from being disengaged from the lock cylinder. The keeper is provided with a spring finger having a prong engageable in a recess in the lock cylinder to provide a simple snap connection.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and accompanying drawings, wherein.

DETAILED DESCRIPTION OF THE PREFERRED EMBODIMENT

Figure 1:
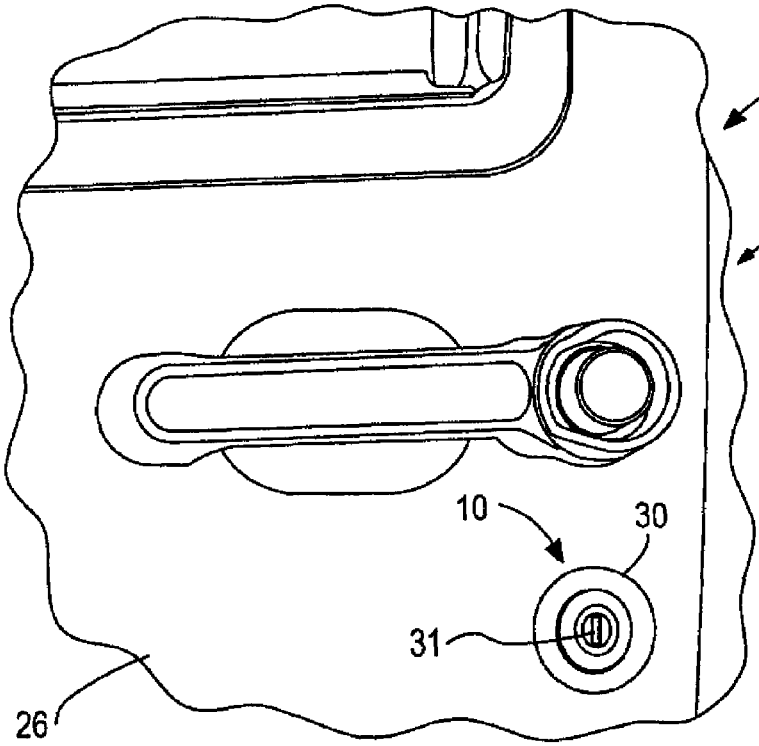
FIG. 1 is a fragmentary elevational view of a door of a motor vehicle as seen from the outside, showing a door handle for opening the door and a door lock assembly constructed in accordance with the invention.
Figure 1A:
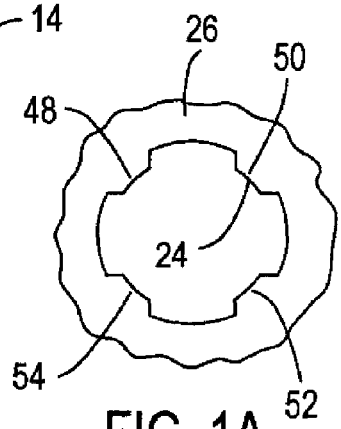
FIG. 1A is a fragmentary view of the outer panel of the door, showing the opening for receiving the door lock assembly.
Figure 2:
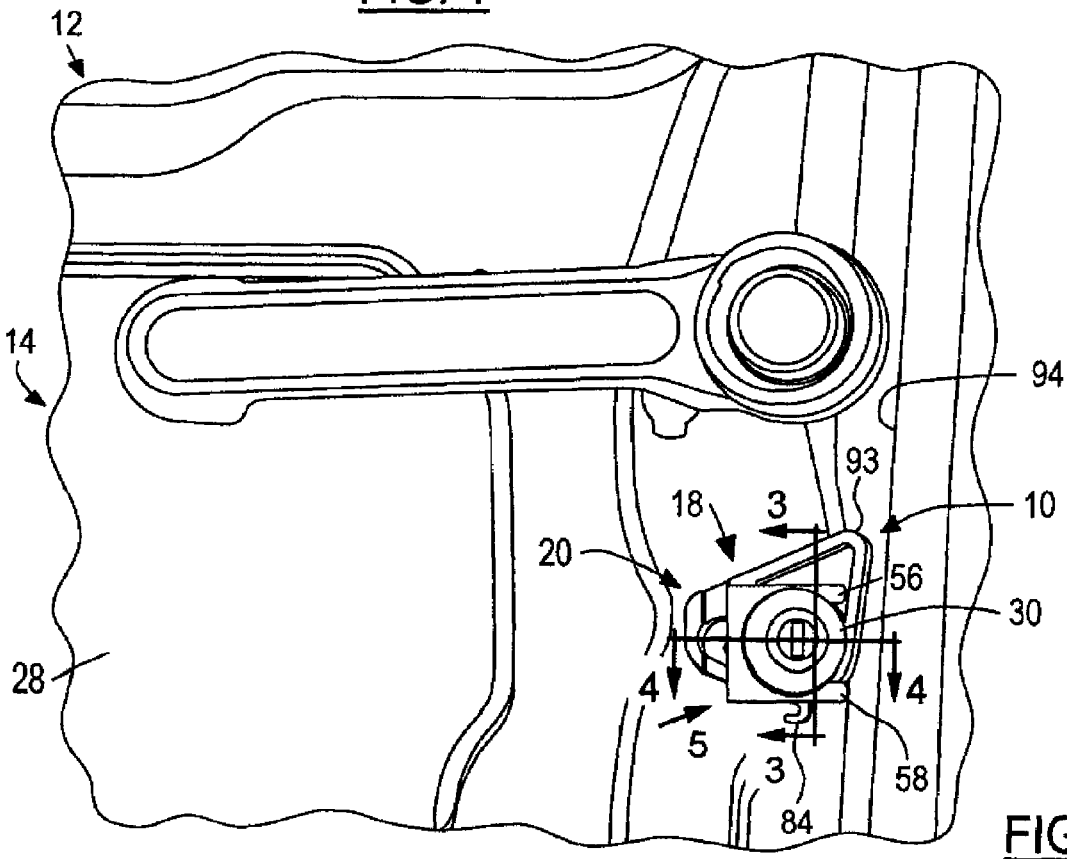
FIG. 2 is a view similar to FIG. 1 but with the outer panel of the door removed.

The following description of the preferred embodiment is merely exemplary in nature and is in no way intended to limit the invention, its application, or uses.

Referring now more particularly to the drawings, there is shown a door lock assembly 10 mounted in a door 12 of a motor vehicle 14. The door lock assembly 10 includes a door lock cylinder 16. A retainer assembly 17 is provided for resisting detachment of the door lock cylinder 16 from the door. The retainer assembly 17 includes a retainer clip 18 and a keeper 20.

The door lock cylinder 16 has an elongated cylindrical body 22 that extends through an opening 24 in an outer panel 26 of the door 12, and into the space between the outer door panel and an inner panel 28 of the door. The door lock cylinder 16 has an enlarged circular head 30 on the outer end of the body 22 which overlies and engages the outer surface of the outer door panel 26. A key slot 31 in the door lock cylinder is adapted to receive a key to lock and unlock the door.

The body 22 of the door lock cylinder 16 has an outer series of four equal angularly spaced apart peripheral lugs 32, 34, 36 and 38 near the head 30, and an inner series of four equal angularly spaced apart peripheral lugs 40, 42, 44 and 46 more remote from the head. The lugs 32-38 are aligned with the respective lugs 40-46 lengthwise of the body 22. The lugs 32-38 fit in notches between retention lugs 48, 50, 52 and 54 in the opening 24 in the outer door panel 26 to prevent the door lock cylinder 16 from rotating relative to the outer door panel.

Figure 3:
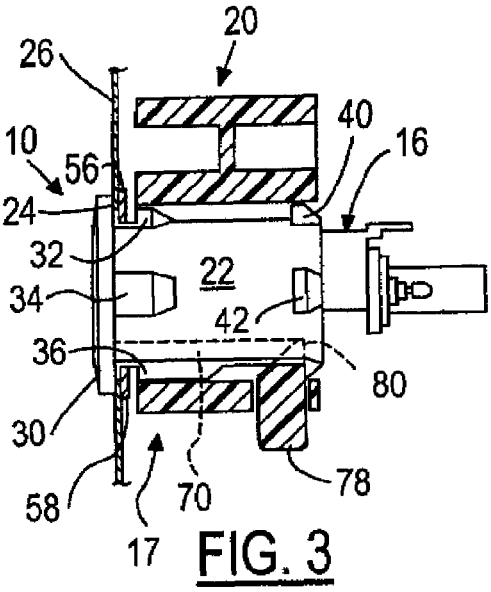
FIG. 3 is a sectional view taken on the line 3-3 in FIG. 2.
Figure 4:
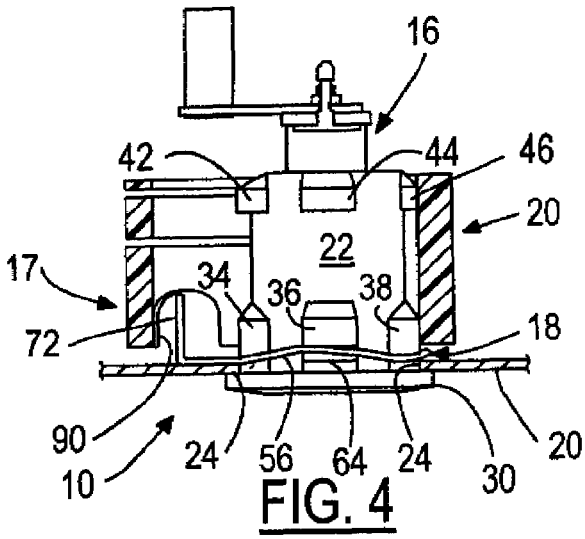
FIG. 4 is a sectional view taken on the line 4-4 in FIG. 2.
Figure 5:
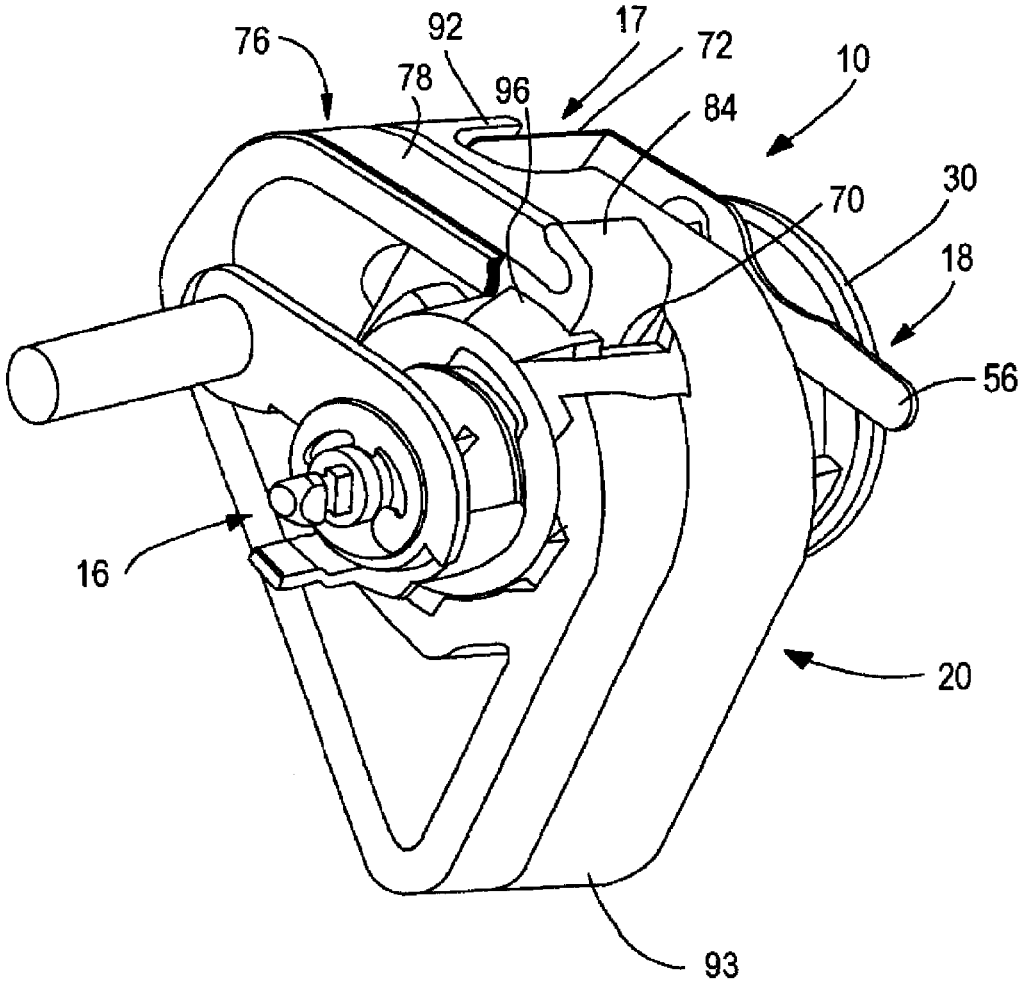
FIG. 5 is a perspective view of the door lock assembly including the door lock cylinder, the retainer clip, and the keeper, as viewed in the direction of the arrow 5 in FIG. 2.
Figure 6:
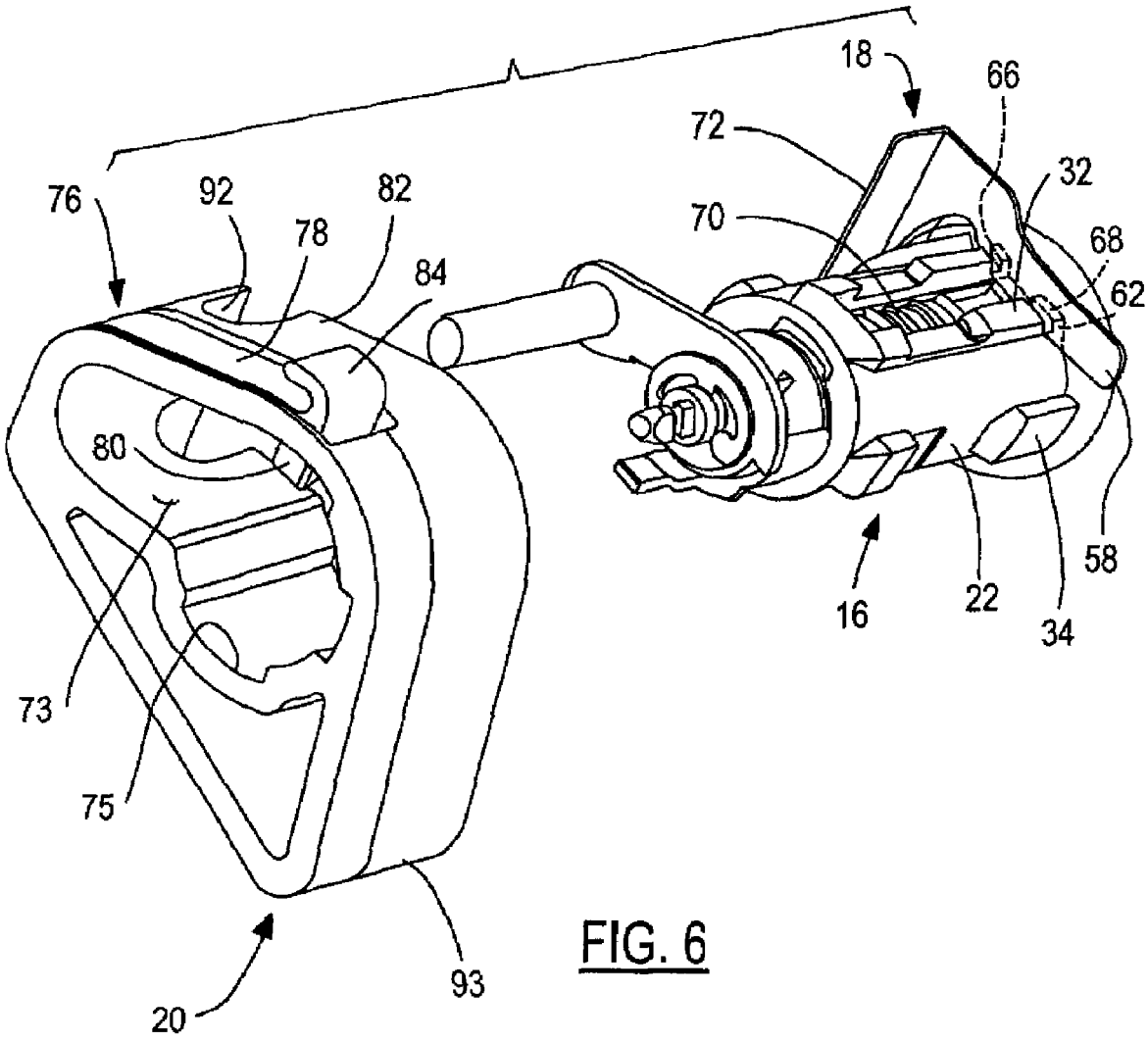
FIG. 6 is an exploded view in perspective of the door lock assembly showing the retainer clip engaged with the body of the door lock cylinder and the keeper separated from the door lock cylinder.
Figure 7:
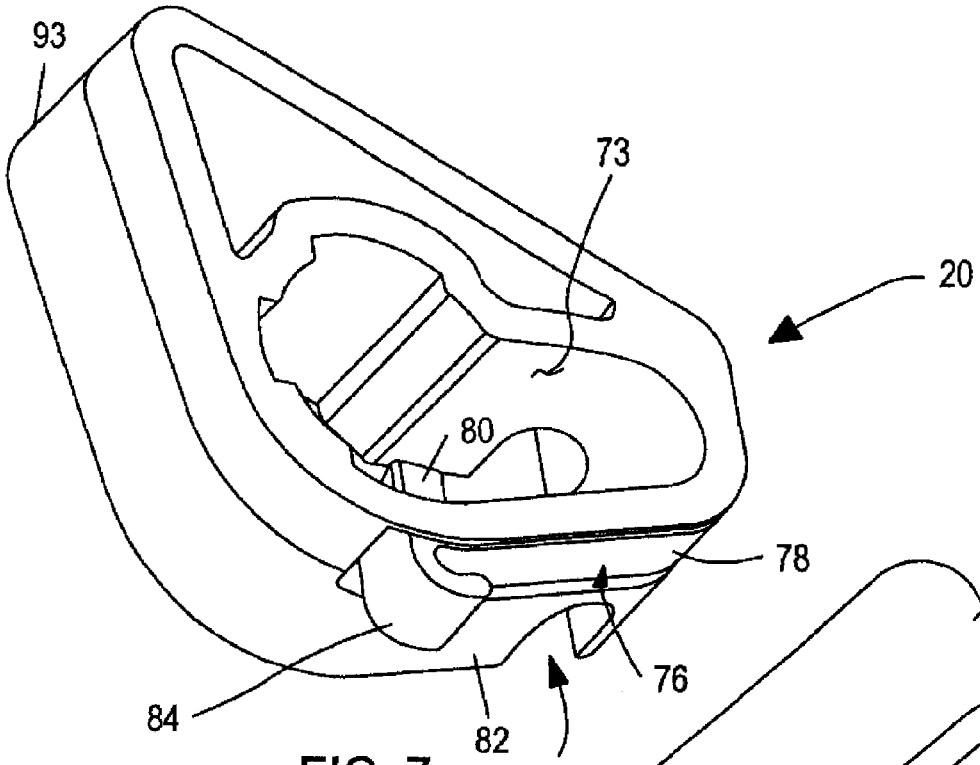
FIG. 7 is a perspective view of the keeper.
Figure 8:
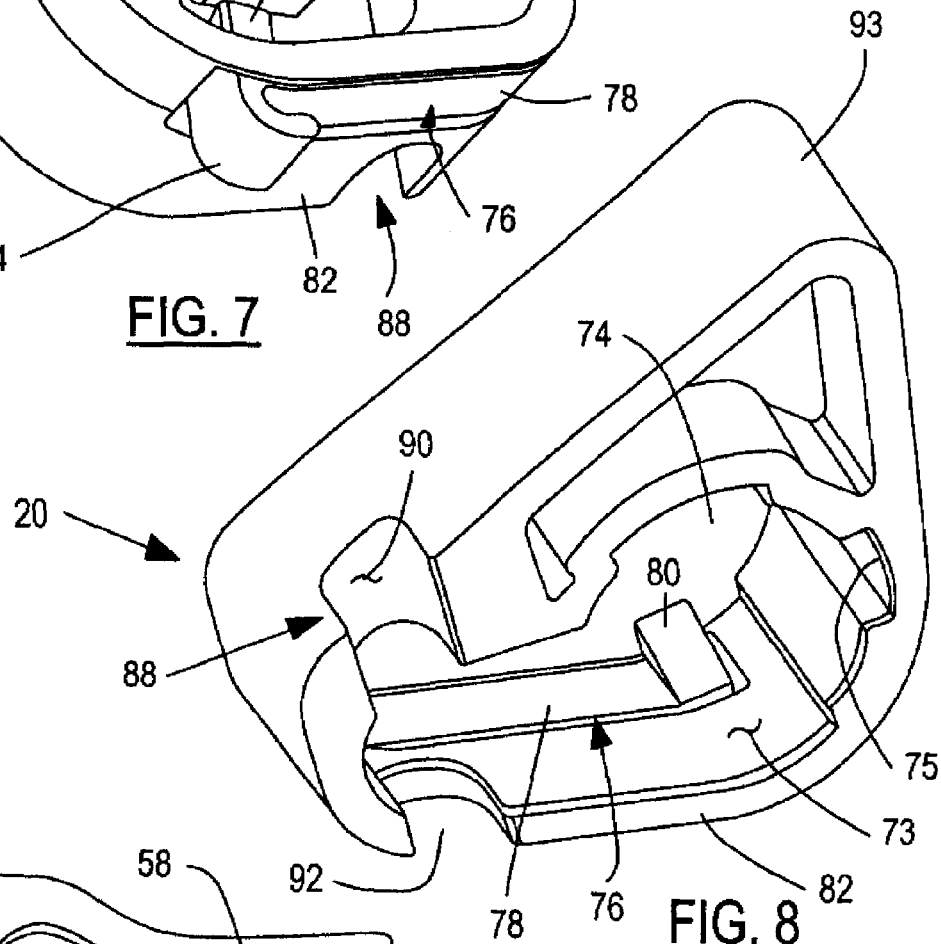
FIG. 8 is a perspective view of the keeper as seen from a different angle.
Figure 9:
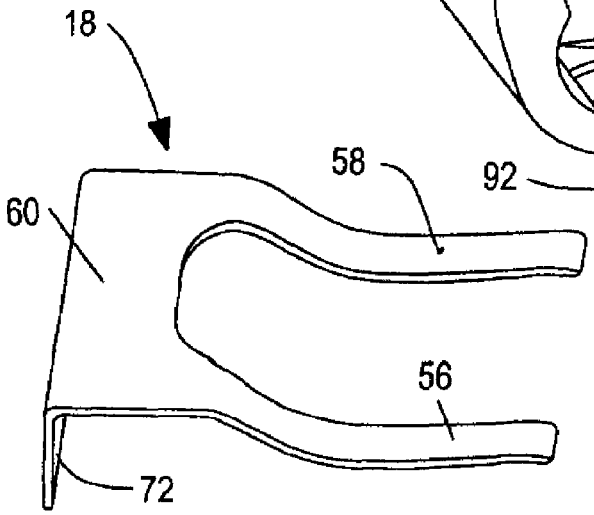
FIG. 9 is a perspective view of the retainer clip.

The retainer assembly 17 including the retainer clip 18 and the keeper 20 are located between the door panels 26 and 28. The retainer clip 18 is provided to keep the door lock cylinder 16 from being punched out or detached from the door as by a person attempting to make an unauthorized forced entry into the vehicle. The retainer clip 18 is best shown in FIG. 9 as a substantially flat, although somewhat dished, stamping which is generally U-shaped and has two laterally spaced part parallel legs 56 and 58 extending away from a transverse base 60 at one end of the legs. When the retainer clip 18 is assembled with the body 22 of the door lock cylinder 16, the legs 56 and 58 straddle the body 22 and are transversely slid through the respective slots 62 and 64 in the lugs 32 and 36. The slot 62 is split into spaced apart slot segments 66 and 68 by a recess in the form of a channel 70 in the body 22 which extends lengthwise of the body. The legs 56 and 58 and base 60 of the retainer clip 18 extend in a plane which is substantially perpendicular to the longitudinal centerline of the body 22 and are close to the inner surface of the outer door panel 26. As seen in FIG. 3, the outer side edges of the legs 56 and 58 extend laterally outwardly beyond the opening 24 in the outer door panel 26 so as to overlap the outer door panel and thus will prevent the cylinder body 22 from being pulled through the opening 22. The base 60 of the retainer clip 18 has a transverse flange 72 which extends perpendicular to the plane of the base for a purpose which will be explained more fully in the description to follow.

The keeper 20 is best shown in FIGS. 5-8 and is provided to keep the retainer clip 18 engaged with the door lock cylinder 16. The keeper 20 is an annular member having an inner surface 73 which defines an opening 74 through which the body 22 of the door lock cylinder 16 extends. The keeper 20 along its inner surface 73 has notches 75 shaped to receive at least some of the lugs 32-38 and 40-46 of the body 22 of the door lock cylinder 16 to prevent the keeper and the door lock cylinder from rotating relative to each other.

The keeper 20 has a retractable insert 76. The insert 76 comprises a spring finger 78 one end of which is made integral with the keeper. The opposite or free end of the spring finger 78 has a prong 80. The spring finger 78 is cut from a wall 82 of the keeper 20 and in its natural, free state condition extends substantially flush with the wall 82, with the prong 80 projected into the channel 70 in the body 22 of the door lock cylinder 16. The prong 80 has a tab 84 which projects outside the keeper body and can be manually gripped to retract the finger 78 radially outward and thereby withdraw the prong 80 from the channel 70 in the body 22. When the tab is released, the spring tension in the finger 78 returns it radially inwardly to the position in which the prong 80 projects into the channel 70.

The keeper 20 has a slot 88 into which the flange 72 on the retainer clip 18 extends. Actually the slot 88 consists of two aligned, laterally spaced apart slot segments 90 and 92. The slot 88 keeps the retainer clip 18 engaged with the body 22 of the door lock cylinder 16 by preventing the retainer clip from being slid out of the slots 62 and 64 in the lugs 32 and 36 of the body.

The keeper 20 has an extension 93 which is opposed to a wall 94 of the inner door panel 28 and will engage the wall 94 to prevent rotation of the keeper and of the door lock cylinder 16 in case of a forced entry in which a person, by inserting a screwdriver into the key slot 31, attempts to rotate the cylinder in the unlocking direction in the outer door panel 26.

To assemble the door lock assembly 10 with the door 12, the body 22 of the door lock cylinder 16 is extended inwardly from the outer side of the door 12 through the opening 24 in the outer door panel 26 into the space between the panels 26 and 28. The retainer clip 18 is applied to the door lock cylinder 16 by sliding it transversely of the body 22 of the door lock cylinder so that the legs 56 and 58 of the retainer clip straddle the body 22 of the door lock cylinder and engage in the slots 62 and 64 of the lugs 32 and 36. The keeper 20 is then slipped over the body 22 so that the prong 80 on the spring finger 78 snaps into the channel 70 in the body and the flange 72 on the retainer clip 18 extends into the slot 88 in the keeper so that the retainer clip cannot be reverse slid out of the slots 62 and 64. In this condition of the parts, the retainer clip 18 retains the door lock cylinder 16 from being pulled or punched out of the door and the keeper 20 keeps the retainer clip from being reverse slid out of engagement with the body 22. The retainer clip 18 cannot rotate relative to the body 22 because of its flange 72 engaging in the slot 88 in the keeper, and the keeper 20 cannot rotate relative to the body 22 or be pulled off of the body because of the prong 80 of the finger 78 engaging the inner end 96 of the channel 70 in the body.

Thus the retainer clip 18 and the keeper 20 are simply snapped or clipped onto the body 22 of the door lock cylinder 16. No other attachment is required. The retainer clip 18 and the keeper 20 are free of direct attachment to the door itself including the door panels.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A retainer assembly for resisting detachment of a door lock cylinder from an opening in a door panel, wherein the door lock cylinder includes a body having a recess, comprising:

a retainer clip adapted to be engaged with the door lock cylinder to prevent the door lock cylinder from being separated from the opening in the door panel wherein said retainer clip has a base and a transverse flange extending from the base, and a keeper for holding said retainer clip engaged with the door lock cylinder and having a slot in which said transverse flange of said retainer clip is received to prevent said retainer clip from becoming disengaged from the door lock cylinder, and also having a retractable insert adapted to be engaged in the recess of the body of the door lock cylinder to prevent relative rotation between said keeper and the body.

2. The retainer assembly of claim 1, wherein said retainer clip has legs adapted to be engaged in grooves in the door lock cylinder.

3. A retainer assembly for resisting detachment of a door lock cylinder having an elongated cylindrical body from an opening in a door panel, comprising:

a retainer clip adapted to be engaged with the door lock cylinder to prevent the door lock cylinder from being separated from the opening in the door panel, said retainer clip is generally U-shaped and extends generally perpendicular to the longitudinal center line of the body of the door lock cylinder, said retainer clip has laterally spaced apart legs straddling the body and adapted to be slidably engaged in grooves in the body, and said retainer clip has a transverse flange, and a keeper for holding said retainer clip engaged with the door lock cylinder, said keeper is annular and fits over the body of the door lock cylinder and said keeper has a slot in which said transverse flange of said retainer clip is received to prevent said retainer clip front becoming disengaged from the door lock cylinder, and wherein the body of the door lock cylinder has a recess, and said keeper has a retractable insert adapted to be engaged in the recess to prevent relative rotation between said keeper and the body of the door lock cylinder.

4. The retainer assembly of claim 3, wherein said insert comprises a spring finger having a prong on one end adapted to be engaged in the recess.

5. The retainer assembly of claim 4, wherein said keeper has an extension engageable with a wall of the door panel to prevent rotation of said keeper in at least one direction.

6. The retainer assembly of claim 5, wherein the door lock cylinder has a head, and, when the door lock cylinder is installed in the opening in the door panel, the head overlies an exterior surface of the door panel and said retainer clip is juxtaposed to an interior surface of the door panel.

7. A retainer assembly for resisting detachment of a door lock cylinder from a door wherein the door comprises spaced apart outer and inner door panels and the door lock cylinder has an elongated, cylindrical body that is extendable through an opening in the outer door panel into a space between the door panels and that includes a recess, comprising:

a retainer clip adapted to be engaged with the body of the door lock cylinder to prevent the door lock cylinder from being removed from the opening in the outer door panel wherein said retainer clip has a base and a transverse flange extending from said base, and a keeper for holding said retainer clip engaged with the body of the door lock cylinder and having a slot in which said transverse flange of said retainer clip is received to prevent said retainer clip from becoming disengaged from the door lock cylinder and also having a retractable insert adapted to be engaged in the recess of the body of the door lock cylinder to prevent relative rotation between said keeper and the body, said retainer clip and said keeper for being disposed between the door panels and being free of direct attachment to the door panels.

8. The retainer assembly of claim 7, wherein said retainer clip is generally U-shaped and extends generally perpendicular to the longitudinal center line of the body, said retainer clip has laterally spaced apart legs straddling the body and slidably engaged in grooves in the body, and said keeper is annular and fits over the body.

9. A retainer assembly for resisting detachment of a door lock cylinder from a door wherein the door comprises spaced apart outer and inner door panels and the door lock cylinder has an elongated, cylindrical body that is extendable through an opening in the outer door panel into a space between the door panels, comprising:

a retainer clip engaged with the body of the door lock cylinder to prevent the door lock cylinder from being removed from the opening in the outer door panel, wherein said retainer clip is generally U-shaped and extends generally perpendicular to the longitudinal center line of the body, said retainer clip has laterally spaced apart legs straddling the body and slidably engaged in grooves in the body, wherein said retainer clip has a transverse flange, and a keeper for holding said retainer clip engaged with the body of the door lock cylinder, said keeper is annular and fits over the body, said keeper has a slot in which said flange is received to prevent said retainer clip from becoming disengaged from the door lock cylinder, said retainer clip and said keeper being adapted to be disposed between the door panels and being free of direct attachment to the door panels, wherein the body of the door lock cylinder has a recess, and said keeper has a retractable insert adapted to be engaged in the recess to prevent relative rotation of said keeper and the body of the door lock cylinder.

10. The retainer assembly of claim 9, wherein said insert comprises a spring finger having a prong on one end adapted to be engaged in the recess.

11. The retainer assembly of claim 10, wherein said spring finger has a tab for manually retracting said spring finger to withdraw said prong from the recess.

12. The retainer assembly of claim 11, wherein said keeper has an extension engageable with a wall of the inner door panel to prevent rotation of the keeper in at least one direction.

13. The retainer assembly of claim 12, wherein the door lock cylinder has a head, and, when the lock cylinder is installed in the opening in the outer door panel, the head overlies an exterior surface of the outer door panel and said retainer clip is juxtaposed to an interior surface of the outer door panel.

* * * * *

UNITED STATES PATENT AND TRADEMARK OFFICE

CERTIFICATE OF CORRECTION

PATENT NO. : 7,444,845 B2
APPLICATION NO. : 11/549666
DATED : November 4, 2008
INVENTOR(S) : John S. Kargilis and Philippe Pontois It is certified that error appears in the above-identified patent and that said Letters Patent is hereby corrected as shown below:

Title page, item (75) Inventor: Philippe Pontols, Sterling Heights, MI (US)
should be: Philippe Pontois, Sterling Heights, MI (US)

Signed and Sealed this

Twentieth Day of January, 2009

JON W. DUDAS
*Director of the United States Patent and Trademark Office*